US009925808B2

(12) United States Patent
Chang

(10) Patent No.: US 9,925,808 B2
(45) Date of Patent: Mar. 27, 2018

(54) PAPER CASSETTE AND PRINTING DEVICE USING THE SAME

(71) Applicant: HON HAI PRECISION INDUSTRY CO., LTD., New Taipei (TW)

(72) Inventor: Yu-Chi Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/253,713

(22) Filed: Aug. 31, 2016

(65) Prior Publication Data

US 2018/0043709 A1 Feb. 15, 2018

(30) Foreign Application Priority Data

Aug. 10, 2016 (CN) ..... 2016 1 0652145

(51) Int. Cl.
*B41J 15/04* (2006.01)

(52) U.S. Cl.
CPC ..... *B41J 15/044* (2013.01)

(58) Field of Classification Search
CPC ..... B41J 13/0081
See application file for complete search history.

(56) References Cited

U.S. PATENT DOCUMENTS 6,246,466 B1 * 6/2001 Hirano ..... B41J 13/0081 271/145
6,523,933 B1 * 2/2003 Hirano ..... B41J 2/16523 347/36
2001/0033314 A1 * 10/2001 Yoshino ..... B41J 2/17513 347/86
2007/0126172 A1 * 6/2007 Nakamura ..... B41J 13/0081 271/145
2007/0195146 A1 * 8/2007 Tanabe ..... B41J 17/32 347/104
2007/0195148 A1 * 8/2007 Ogawa ..... B41J 17/32 347/104

* cited by examiner

*Primary Examiner* — Bradley Thies
(74) *Attorney, Agent, or Firm* — ScienBiziP, P.C.

(57) ABSTRACT

A paper cassette includes a casing and an end cap. The casing includes a receiving space for storing a stack of paper, one side of the casing defines a paper exit, the end cap is removably attached to the paper exit. When the paper exit is sealed by the end cap, the paper cassette is used to accommodate paper; when the end cap is removed from the paper exit and the paper cassette is inserted into a printing device, the paper cassette is used to feed paper to the printing device. A printing device is further disclosed.

12 Claims, 5 Drawing Sheets

PAPER CASSETTE AND PRINTING DEVICE USING THE SAME

FIELD

The subject matter herein generally relates to a paper cassette and a printing device using the paper cassette.

BACKGROUND

A portable printer is capable of printing photos anywhere anytime, which enables instant sharing. Different kinds of recording medium, such as gum applied paper, paper of specific color resolution, paper with label area, paper with eyelet, can be adopted to meet special printing needs.

In conventional portable printers, different kinds of paper is packaged and classified by individual paper bags. Multiple steps should be involved to change the paper in the printer, such as in the process of replacing paper A in the printer with paper B, the following steps are essential: opening the printer, taking out paper A left in the printer, opening the paper bag of paper A, putting paper A into the corresponding paper bag, opening the paper bag of paper B, taking out paper B, putting paper B into the printer, shutting the printer. The procedure to change paper therefore becomes complicated, and paper could be polluted during the procedure due to touching by hands.

BRIEF DESCRIPTION OF THE DRAWINGS

Implementations of the present technology will now be described, by way of example only, with reference to the attached figures.

DETAILED DESCRIPTION

Figure 1:
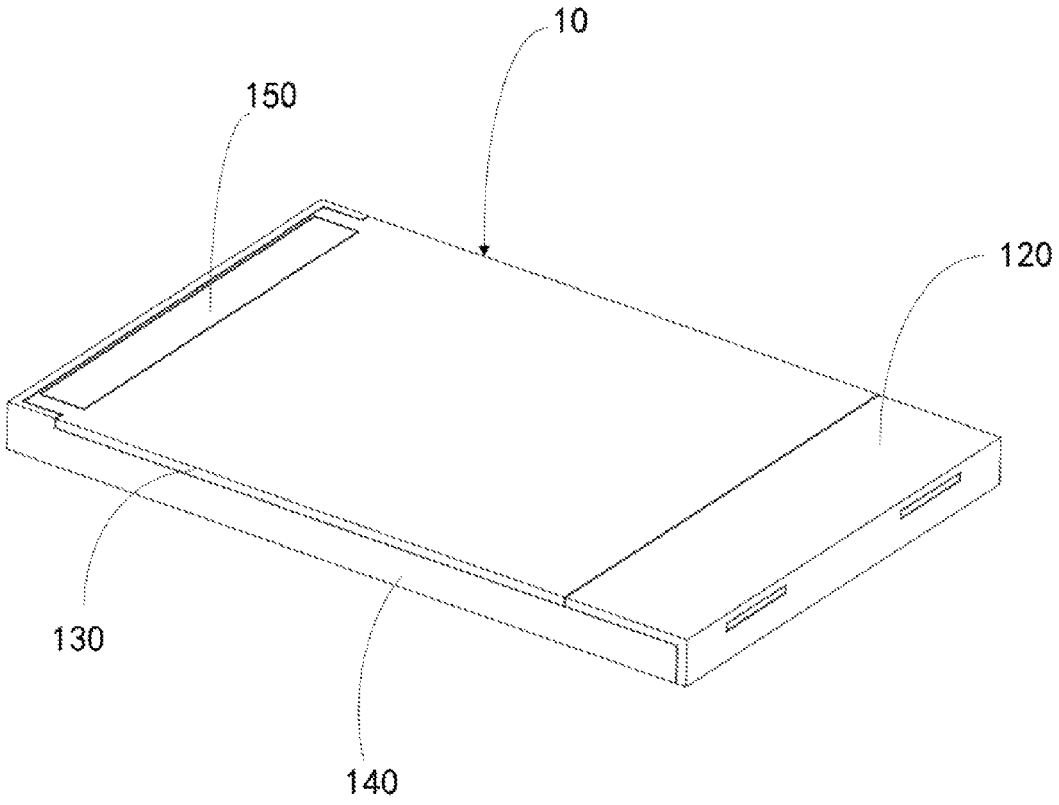
FIG. 1 is an isometric view of one embodiment of a paper cassette.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "inside" indicates that at least a portion of an object is contained within a boundary formed by another object. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series and the like.

Figure 2:
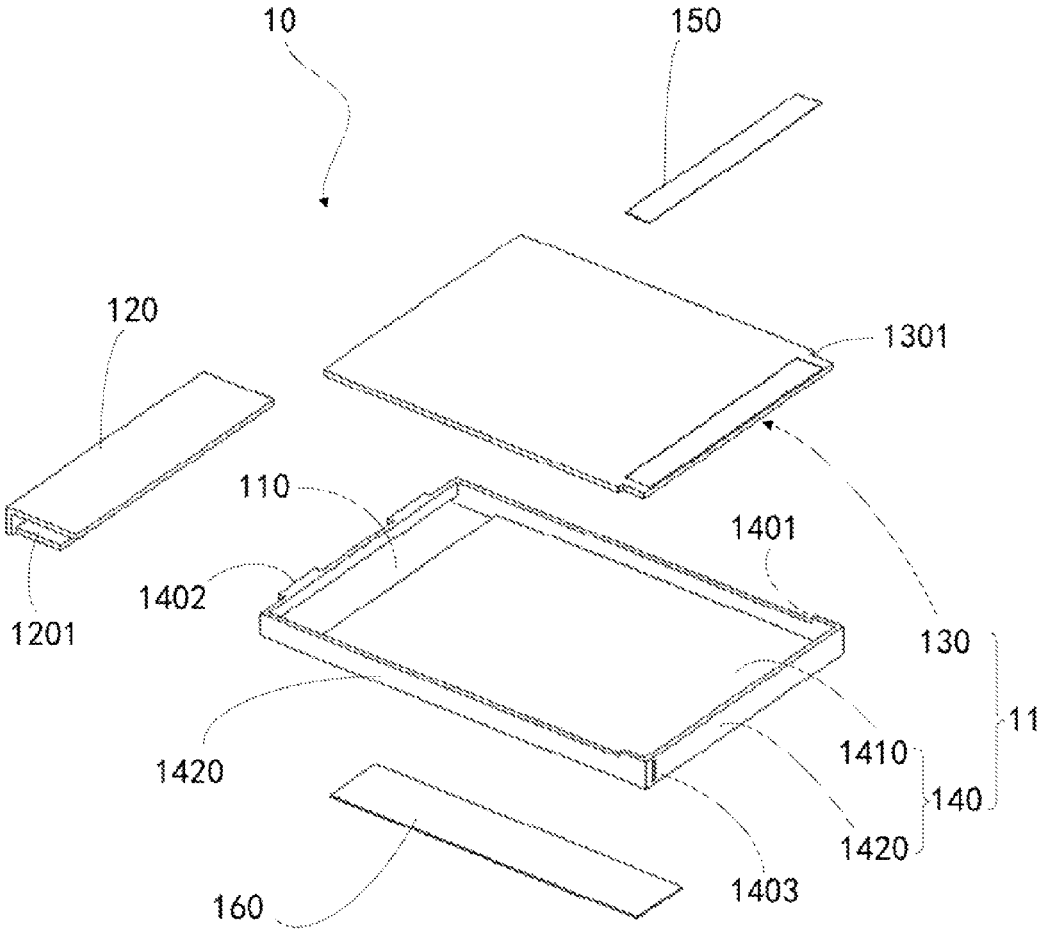
FIG. 2 is an exploded view of the paper cassette of FIG. 1.

FIGS. 1 and 2 illustrate a paper cassette in accordance with an embodiment.

The paper cassette 10 includes a casing 11 and an end cap 120. A receiving space for storing a stack of paper is defined in the casing 11. One side of the casing 11 defines a paper exit 110, the end cap 120 is removably attached to the paper exit 110.

When the paper exit 110 is sealed by the end cap 120, the paper cassette 10 is used as an container, paper can be kept away from outer space and would not be touched by hands, thus avoid pollution during storage and transportation. When the end cap 120 is removed from the paper exit 110 and the paper cassette 10 is inserted into a printing device 1, the paper cassette 10 can feed paper to the printing device 1 from the paper exit 110.

The casing 11 can be molded in one body as well as an assembly of a lower casing 140 and an upper casing 130. In the latter case, the receiving space can be formed in the lower casing 140, the paper exit 110 can be formed on the bottom of the lower casing 140.

In at least one embodiment, the lower casing 140 can include a bottom plate 1410 and a plurality of side plates 1420 enclosing on the bottom plate 1410, the upper casing 130 is mounted on the upper end of the plurality of side plates. As paper is usually rectangular, the bottom plate 1410 can be a rectangular plate with equal size of the paper inside. One end of the rectangular plate defines a gap, the gap can be used as the paper exit 110. The lower end of the side plate 1420 next to the gap keeps a distance from the bottom plate, so that the end of the paper inside can protrude under the side plate 1420.

The top of the casing 11 can define an opening for a platen assembly to pass through, the opening locates over the paper exit 110.

One of the side plates 1420 can define a viewing window 1403. In an embodiment, when the paper cassette 10 is inserted into a printing device 1, the side plate 1420 exposed can be made of transparent materials, so that the paper inside can be directly observed. One of the side plates 1420 can be partially transparent to meet special requirements of application occasions, such as the paper in the paper cassette 10 is light-sensitive, in this condition, the viewing window 1403 can be a long and narrow transparent portion of the side plate 1420 spreads along with the stack of the paper, the rest of the side plate 1420 is light-proof to prevent lights from passing through.

One side of the upper casing 130 defines at least one first slot 1301, one side of the lower casing 140 defines at least one second slot 1401, the second slot 1401 can be fixed to the first slot 1301, the one side of the upper casing 130 is mounted to the one side of the lower casing 140 via the first slot 1301 and the second slot 1401. The end cap 120 defines a clamping portion 1201 on its end, the other side of the lower casing 140 defines a protrusion 1402 on an outer surface of a side plate, the protrusion 1402 is clamped to the other side of the upper casing 130 by the clamping portion 1201 of the end cap 120. When the protrusion 1402 is clamped to the upper casing 130, the paper exit is sealed by the clamping portion 1201 of the end cap 120.

An information label 150 and a scanning label 160 can be stuck on the outer surface of the casing. The information label 150 indicates information about the paper in the casing, bar code or QR code the scanning label 160. The scanning label 160 can be bar-coded or QR-coded to be scanned by the printing device 1 to get the printing device 1 preset.

Figure 3:
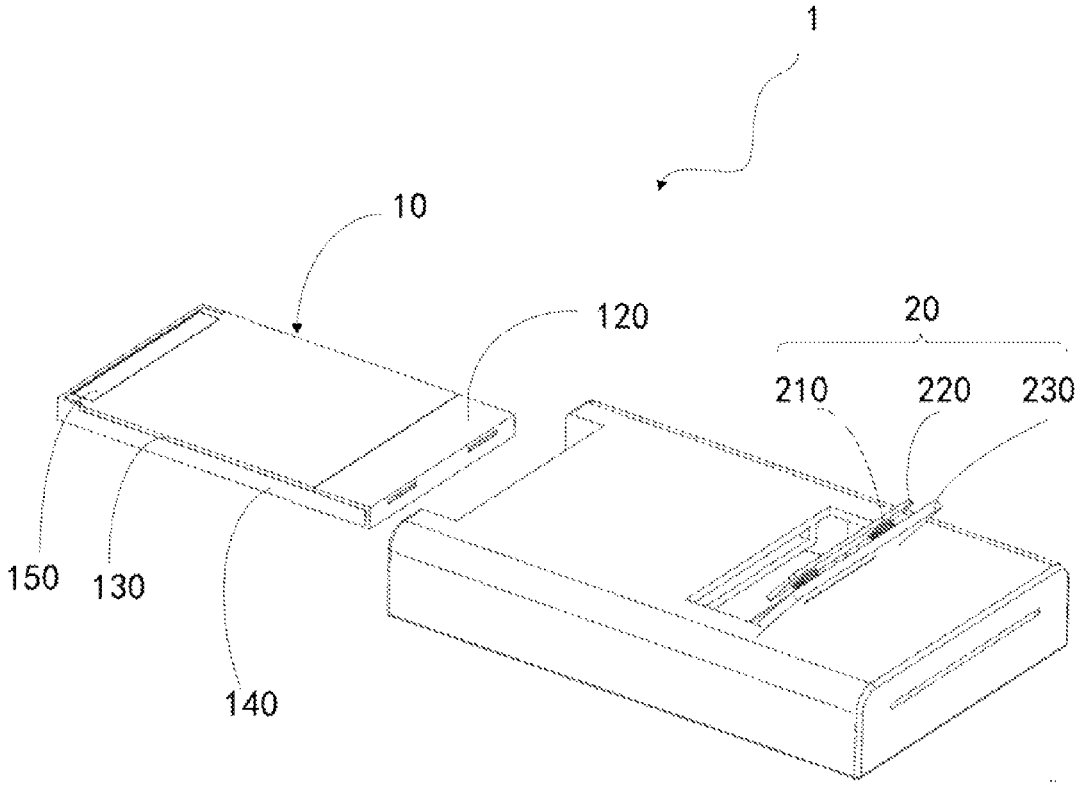
FIG. 3 is a partially exploded view of one embodiment of a printing device.
Figure 4:
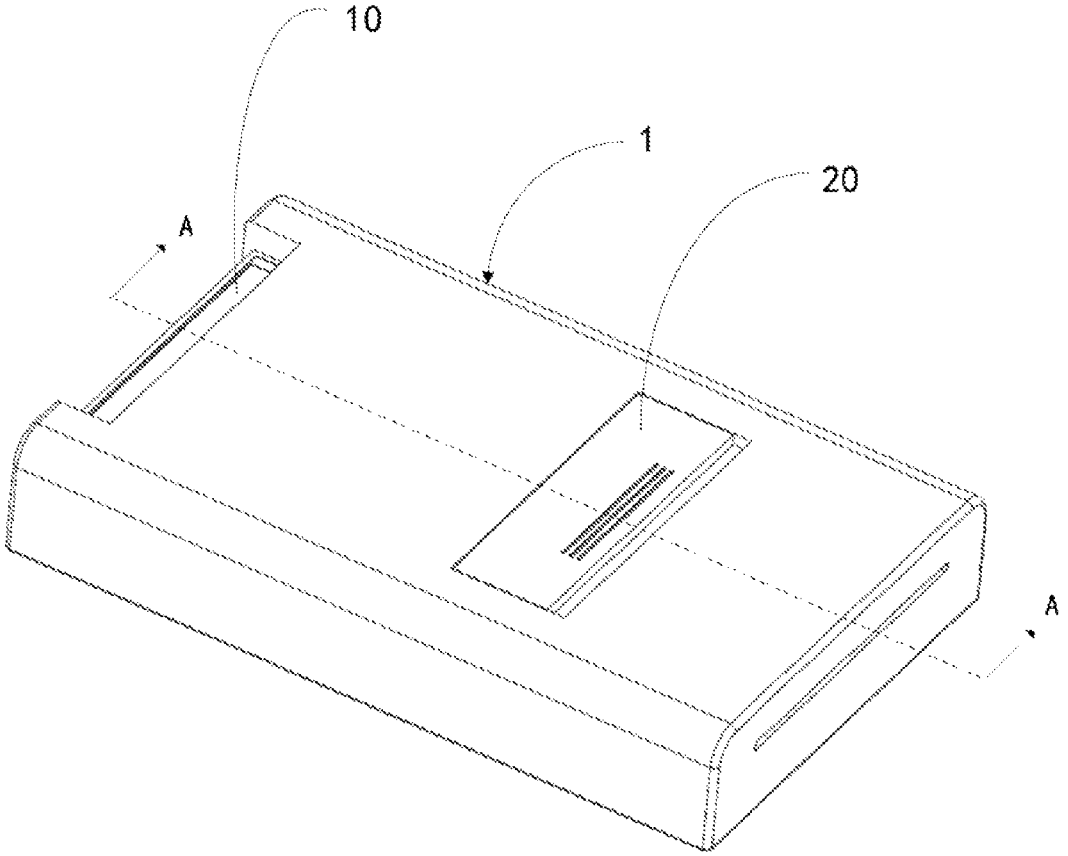
FIG. 4 is an assembled, isometric view of the printing device of FIG. 3.
Figure 5:
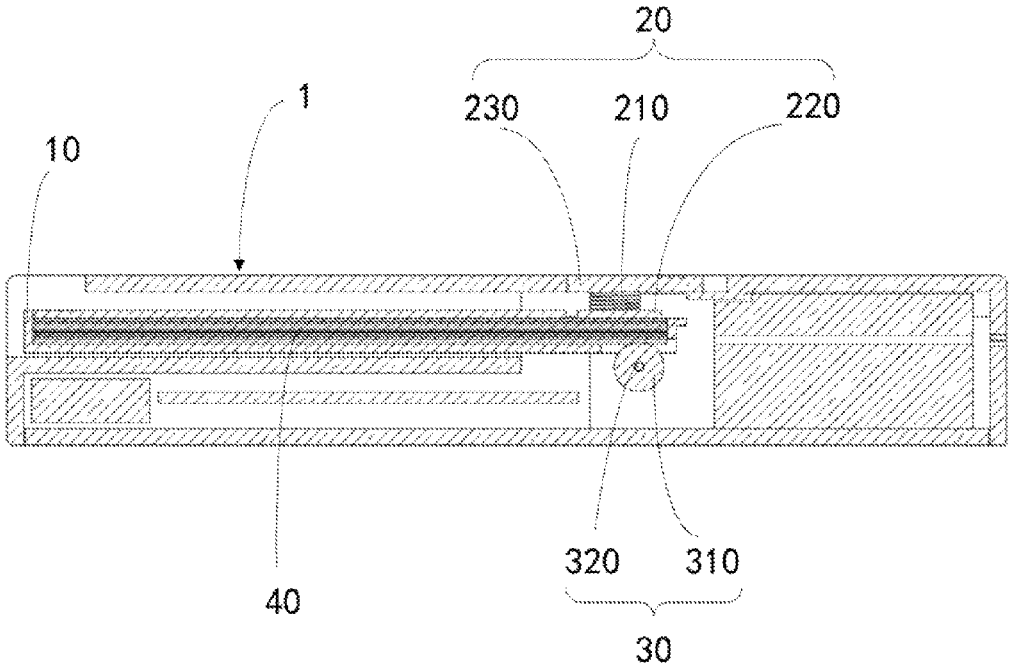
FIG. 5 is a sectional view of the printing device of FIG. 4, taken along a line A-A.

FIGS. 3-5 illustrate a printing device in accordance with an embodiment.

The printing device 1 includes a pickup assembly 30, a platen assembly 20 and a paper cassette 10. The paper cassette 10 is illustrated with embodiments above.

The pickup assembly 30 includes a drive unit and a roller 310 driven by the drive unit, the roller 310 can rotate around an axis 320. When the paper cassette 10 is received in the printing device 1, the paper 40 in the paper cassette 10 is pressed by the platen assembly 20, the roller 310 resists against the paper and driven by the drive unit to rotate to feed paper to the printing device 1 by friction.

The platen assembly 20 includes an elastic member 210, such as a spring or a shrapnel, and a resistance plate 220 fixed to an end of the elastic member 210, when the paper cassette 10 is received in the printing device 1, the platen assembly 20 is located over the opening of the paper cassette 10, the elastic member 210 is compressed and the resistance plate 220 impacts on the paper, so that the roller 310 could resist against the paper and friction could be produced to feed paper to the printing device 1.

In at least one embodiment, the platen assembly 20 further includes a turnover plate 230, the turnover plate 230 is fixed to the other end of the elastic member 210, and the turnover plate 230 is rotatably fixed to a pivot of the printing device 1. When the paper cassette 10 is received in the printing device 1, the elastic member 210 and the resistance plate 220 are turned to the opening with the turnover plate 230, otherwise the elastic member 210 and the resistance plate 220 are turned away from the opening, the paper cassette 10 can be taken out of the printing device 1.

The embodiments shown and described above are only examples. Even though numerous characteristics and advantages of the present technology have been set forth in the foregoing description, together with details of the structure and function of the present disclosure, the disclosure is illustrative only, and changes may be made in the details, including matters of shape, size, and arrangement of the parts within the principles of the present disclosure, up to and including the full extent established by the broad general meaning of the terms used in the claims.

What is claimed is:

1. A paper cassette comprising:

a casing comprising a receiving space for storing a stack of paper, one side of the casing defines a paper exit; and an end cap removably attaching to the paper exit;

wherein the casing comprises a lower casing and an upper casing, the receiving space is defined in the lower casing, and the paper exit is formed on the bottom of the lower casing; the top of the casing defines an opening for a platen assembly to pass through, the opening locates over the paper exit;

wherein the lower casing comprises a bottom plate and a plurality of side plates enclosing on the bottom plate, the upper casing is mounted on the upper end of the plurality of side plates; the paper exit is defined in the joint of the bottom plate and a side plate;

when the paper exit is sealed by the end cap, the paper cassette is used to accommodate paper; when the end cap is removed from the paper exit and the paper cassette is inserted into a printing device, the paper cassette is used to feed paper to the printing device.

2. The paper cassette of claim 1, wherein one side of the upper casing defines at least one first slot, one side of the lower casing defines at least one second slot fixed to the first slot, the one side of the upper casing is mounted to the one side of the lower casing via the first slot and the second slot.

3. The paper cassette of claim 2, wherein the end cap comprises a clamping portion, the other side of the lower casing defines a protrusion on an outer surface of a side plate, the protrusion is clamped to the other side of the upper casing by the clamping portion of the end cap.

4. The paper cassette of claim 1, wherein the casing further comprises an information label and a scanning label; the information label indicates information about the paper in the casing, the scanning label is used to be scanned by the printing device to get the printing device preset.

5. A printing device comprising:

a pickup assembly;

a platen assembly; and a paper cassette comprising:

a casing comprising a receiving space for storing a stack of paper, one side of the casing defines a paper exit; and an end cap removably attaching to the paper exit;

wherein the casing comprises a lower casing and an upper casing, the receiving space is defined in the lower casing, and the paper exit is formed on the bottom of the lower casing; the top of the casing defines an opening for a platen assembly to pass through, the opening locates over the paper exit;

wherein the lower casing comprises a bottom plate and a plurality of side plates enclosing on the bottom plate, the upper casing is mounted on the upper end of the plurality of side plates; the paper exit is defined in the joint of the bottom plate and a side plate;

when the paper exit is sealed by the end cap, the paper cassette is used to accommodate paper;

when the end cap is removed from the paper exit and the paper cassette is inserted into the printing device, the paper in the paper cassette is pressed by the platen assembly and picked up by the pickup assembly to be fed to the printing device.

6. The printing device of claim 5, wherein one side of the upper casing defines at least one first slot, one side of the lower casing defines at least one second slot fixed to the first slot, the one side of the upper casing is mounted to the one side of the lower casing via the first slot and the second slot.

7. The printing device of claim 6, wherein the end cap comprises a clamping portion, the other side of the lower casing defines a protrusion on an outer surface of a side plate, the protrusion is clamped to the other side of the upper casing by the clamping portion of the end cap.

8. The printing device of claim 5, wherein the casing further comprises an information label and a scanning label; the information label indicates information about the paper in the casing, the scanning label is used to be scanned by the printing device to get the printing device preset.

9. The printing device of claim 5, wherein the pickup assembly is located under the paper exit of the paper cassette when the paper cassette is received in the printing device.

10. The printing device of claim 9, wherein the pickup assembly comprises a drive unit and a roller driven by the drive unit; when the paper cassette is received in the printing device, the paper in the paper cassette is pressed by the platen assembly, the roller resists against the paper and driven by the drive unit to rotate to feed paper to the printing device by friction.

11. The printing device of claim 5, wherein the platen assembly comprises an elastic member and a resistance plate fixed to an end of the elastic member, when the paper cassette is received in the printing device, the platen assembly is located over the opening of the paper cassette, the elastic member is compressed and the resistance plate impacts on the paper.

12. The printing device of claim 11, wherein the platen assembly further comprises a turnover plate, the turnover plate is fixed to the other end of the elastic member, and the turnover plate is rotatably fixed to a pivot of the printing device; when the paper cassette is received in the printing device, the elastic member and the resistance plate are turned to the opening with the turnover plate, otherwise the elastic member and the resistance plate are turned away from the opening.

* * * * *